United States Patent [19]

Scholzen

[11] Patent Number: 4,841,637

[45] Date of Patent: Jun. 27, 1989

[54] DISPOSABLE FLATWARE

[76] Inventor: Werner Scholzen, Jahnstrabe 12, Haan, Fed. Rep. of Germany

[21] Appl. No.: 243,063

[22] Filed: Sep. 9, 1988

[30] Foreign Application Priority Data

Sep. 11, 1987 [DE] Fed. Rep. of Germany ..... 3730507

[51] Int. Cl.[4] ..... B26B 1/00

[52] U.S. Cl. ..... 30/125; 30/141; 30/324

[58] Field of Search ..... 30/124, 125, 141, 324–328; D7/137

[56] References Cited

U.S. PATENT DOCUMENTS 2,252,119 8/1941 Edmonds ..... 30/125 U X
2,453,525 11/1948 McNeill ..... 30/125 X
3,410,457 11/1968 Brown ..... 30/125 X

FOREIGN PATENT DOCUMENTS 730312 1/1943 Fed. Rep. of Germany ..... 30/324

*Primary Examiner*—Douglas D. Watts
*Attorney, Agent, or Firm*—Becker and Becker

[57] ABSTRACT

Flatware, especially a spoon, for disposable use. The flatware comprises a front work part and a rear handle that is formed on the work part and in which are provided a plurality of chambers that are separated from one another for receiving different ingredients. Respective channels that are separated from one another are provided in the handle and establish communication between the chambers and respective discharge outlets that are disposed in the vicinity of where the work part and handle merge, and that are closed-off until used.

8 Claims, 3 Drawing Sheets

1
2
3a
3b
3c
4
5a
5b
5c
6a
6b
6c
8a
8b
8c
9a
9b
9c
17
18
19

DISPOSABLE FLATWAREu

BACKGROUND OF THE INVENTION

The present invention relates to flatware, especially a spoon, for throw-away or disposable use, including a front work part and a rear handle that is formed thereon and in which is provided chamber means for receiving material, with the chamber means communicating via channel means disposed within the flatware with discharge outlet means that is disposed in the vicinity of the work part and is closed-off when not being used.

A disposable flatware of this type, in the form of a spoon, is known from German Pat. No. 35 03 167. The known spoon is an injection molded plastic part, and comprises a front spoon bowl on which is formed a rear spoon handle. This handle is provided with a single chamber for receiving an ingredient, for example for receiving milk or sugar for a beverage. So that the material ean be dispensed from the chamber, a channel that is disposed within the plastic material of the spoon proceeds from the chamber. This channel opens into a discharge outlet in the transition region between the bowl and the handle of the spoon. When not being used, this discharge outlet is closed, and can be opened when needed, so that in the region of the spoon bowl milk or sugar, for example, is dispensed and can be added to the beverage.

Unfortunately, since the heretofore known disposable spoon is provided with only a single chamber, only a single ingredient can be stored therein and is available for use. Thus, for example, it is possible to store only either milk or sugar in the handle of the spoon, and not both milk and sugar, although both may be desired, so that one of these ingredients must be stored and dispensed separately, thus increasing costs.

It is therefore an object of the present invention to provide an improved disposable flatware that allows several ingredients to be stored separately from one another in the handle thereof.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
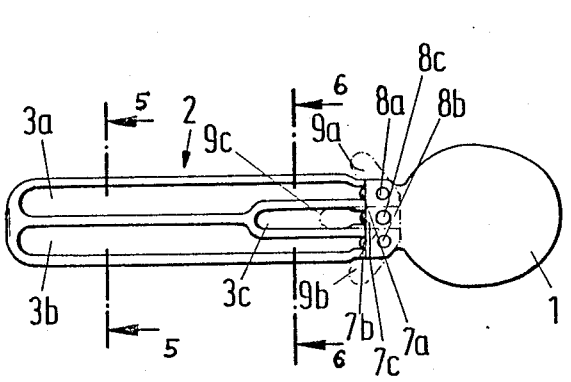
FIG. 1 is a plan view of a first exemplary embodiment of the inventive flatware in the form of a disposable spoon.

The flatware of the present invention comprises a front work part, and a rear handle that is formed on the work part and in which are provided a plurality of chambers that are separated from one another for receiving different ingredients; respective channels that are separated from one another are provided in the handle and establish communication between the chambers and respective discharge outlets that are disposed in the vicinity of where the work part and the handle merge, and that are closed-off until used.

A flatware embodied pursuant to the present invention has the advantage that several, especially two or three, ingredients can be stored in corresponding chambers in the handle and can be appropriately dispensed when needed. Since each of the chambers is provided with its own discharge outlet, the ingredients can be dispensed separately from one another by opening the corresponding discharge outlet. If a user does not want one of the ingredients at all, he can keep the corresponding chamber closed and can satisfy himself with the other ingredients in the remaining chambers. Thus, for example, a spoon can comprise three chambers, with the first chamber containing a tea or coffee concentrate, the second chamber containing condensed milk, and the third chamber containing sugar concentrate. Such a spoon is particularly suitable, for example, for tea and coffee vending machines, since it is merely necessary to dispense hot water as well as the inventive spoon. The user can then first add the tea of coffee concentrate from the spoon handle to the hot water, and can subsequently add condensed milk and/or sugar concentrate as desired. Thus, one advantage of the present invention is that it is very easy with such beverage vending machines to in this manner fulfill the very strict hygiene regulations, particularly with regard to the condensed milk, which has up to now always caused hygiene problems. With the present invention, the condensed milk keeps for a long time in the spoon handle without having to fear any adverse effects thereon. Moreover, such a spoon with several chambers is suitable for serving passengers in airplanes, for example when serving tea or coffee. The inventive spoon is also very suitable for camping trips.

Each of the discharge outlets is preferably closed-off or sealed by a pull tab. After the chambers have been filled with the ingredients, such pull tabs can easily be attached to thereby seal the discharge outlets. As the need arises, the pull tabs can then be individually removed for selective withdrawal of the ingredients, thus enabling a more rapid access, without any difficulty, to the contents of the chambers in the handle.

Pursuant to one preferred embodiment of the handle of the present invention, this handle comprises a flat, inherently stable frame in which are formed openings that are associated with the respectively chambers. Molded on both sides of the frame, to form the chambers, are respective bulged walls, at least a portion of which are resiliently deformable. The frame imparts to the handle the necessary internal stability, while the chambers formed by the bulged walls can each receive a large quantity of an ingredient. In comparison to the chambers, the frame takes up only very little space, so that the greatest part of the handle is available for receiving ingredients. As a result of the resilient deformability of these bulged walls, it is possible to press the appropriate ingredient out of the respective chamber in a simple manner.

Pursuant to a first embodiment for a division of the chambers, it is proposed to provide a total of three chambers, whereby at the rear end of the handle two chambers are disposed that extend next to one another in the longitudinal direction of the handle and extend toward the front end of the handle, and whereby at the front end of the handle between the first and second chambers the third chamber is disposed in such a way that it extends parallel to the two first chambers, with the first and second chamber each having a reduced cross-sectional area in this region.

In a second embodiment for the division of the chambers, it is proposed that a total of three chambers be provided, whereby at the rear end of the handle a first chamber is disposed that extends over the entire width of the handle and extends toward the front end of the handle, where the central portion of this chamber has a reduced cross-sectional area, and whereby in this tapered region of the first chamber the second and third chambers are disposed on both sides.

Finally, pursuant to a third embodiment for division of the chambers, it is proposed that a total of three chambers be provided, whereby starting from the rear end toward the front end of the handle, the three chambers are disposed in a staggered arrangement one after the other, with all three chambers extending next to one another at the front end of the handle.

These various chamber divisions make it possible on the one hand to provide chamber shapes of different sizes in conformity to the quantity of ingredient that is to be supplied, and on the other hand permit the ingredients to be pressed out of their respective chambers in an optimum manner.

Further specific features of the present invention will be described in detail subsequently.

DESCRIPTION OF PREFERRED EMBODIMENTS

Figure 2:
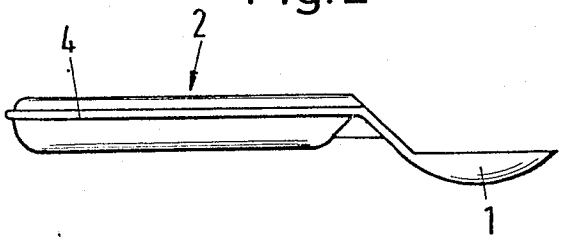
FIG. 2 is a side view of the embodiment of FIG. 1.
Figure 3:
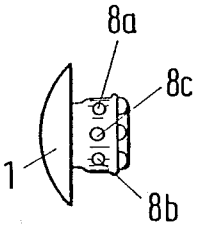
FIG. 3 is a view from the front.
Figure 4:
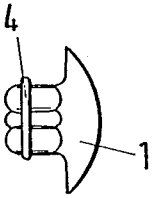
FIG. 4 is a view from behind.
Figure 5:
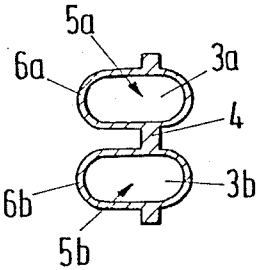
FIG. 5 is an enlarged cross-sectional view taken along the line 5—5 in FIG. 1.
Figure 6:
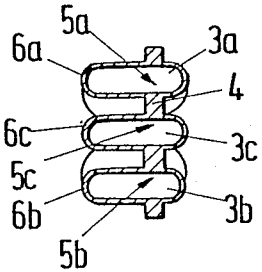
FIG. 6 is an enlarged cross-sectional view taken along the line 6—6 in FIG. 1.
Figure 10:
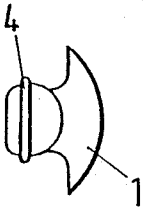
FIG. 10 is a view from behind.
Figure 12:
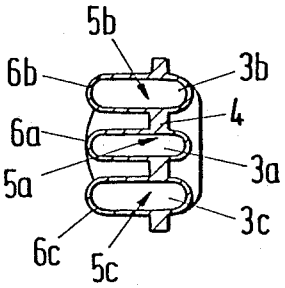
FIG. 12 is an enlarged cross-sectional view taken along the line 12—12 in FIG. 7.
Figure 7:
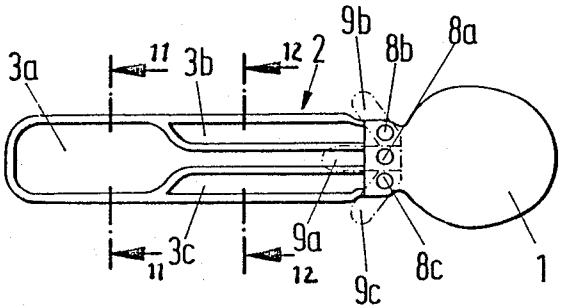
FIG. 7 is a plan view of a second exemplary embodiment of an inventive disposable spoon.
Figure 8:
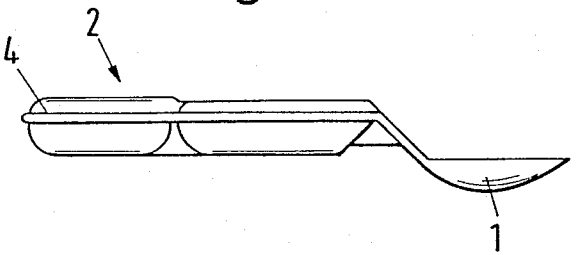
FIG. 8 is a side view of the embodiment of FIG. 7.
Figure 9:
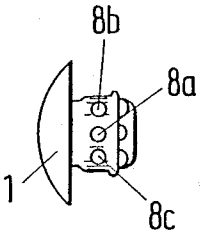
FIG. 9 is a view fron the front.
Figure 11:
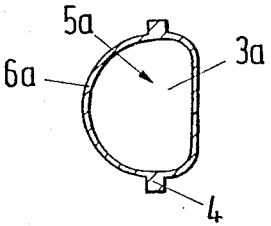
FIG. 11 is an enlarged cross-sectional view taken along the line 11—11 in FIG. 7.
Figures 13, 14, 15, 16, 17, 18, 19:
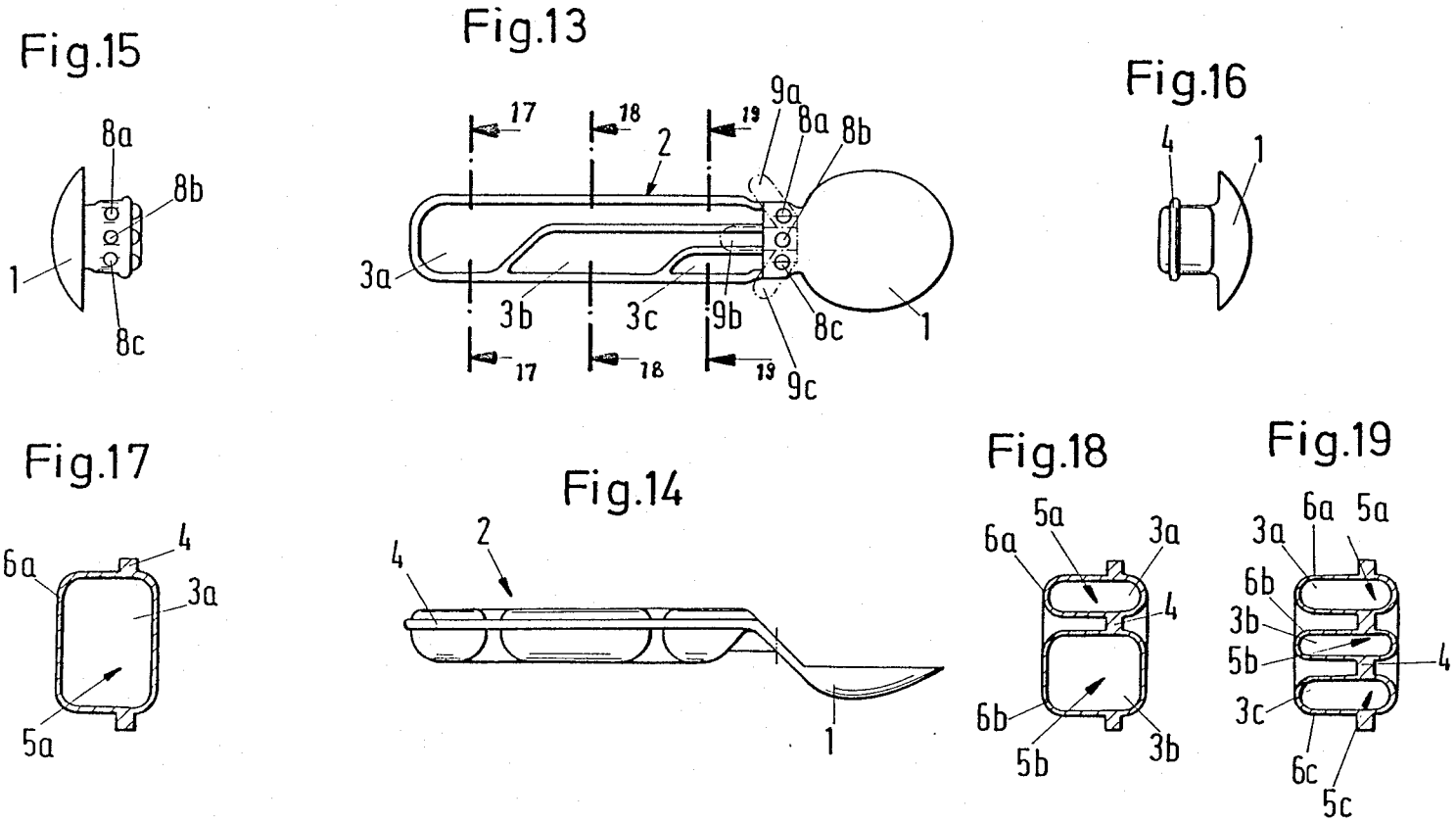
FIG. 13 is a plan view of a third exemplary embodiment of an inventive disposable spoon.
FIG. 14 is a side view of the embodiment of FIG. 13.
FIG. 15 is a view from the front.
FIG. 16 is a view from behind.
FIG. 17 is an enlarged cross-sectional view taken along the line 17—17 in FIG. 13.
FIG. 18 is an enlarged cross-sectional view taken along the line 18—18 in FIG. 13.
FIG. 19 is an enlarged cross-sectional view taken along the line 19—19 in FIG. 13.

Referring now to the drawings in detail, FIGS. 1 to 6 illustrate a first exemplary embodiment, FIGS. 7 to 12 illustrate a second exemplary embodiment, and FIGS. 13 to 19 illustrate a third exemplary embodiment of the inventive disposable spoon. These three embodiments differ from one another only in that they have varying chamber divisions; the basic construction of these embodiments is, however, the same.

Thus, for example, each of the disposable spoons comprises a plastic injection molded part having a front scoop or bowl 1 and a rear shank or handle 2 that is formed thereon. As can be seen in particular in the cross-sectional views of the various embodiments, provided in each handle 2 are three chambers 3*a*, 3*b*, and 3*c* for receiving different materials or ingredients. Such ingredients can, for example, be a tea or coffee concentrate, powdered or condensed milk, as well as a sugar concentrate; these ingredients can be used as desired to make tea or coffee.

As can also be clearly seen in the cross-sectional views, the handle 2 comprises a flat and relatively inherently stable frame 4 that imparts the necessary rigidity to the handle 2. Formed in the frame 4 are openings 5*a*, 5*b*, and 5*c* with which are associated corresponding chambers 3*a*, 3*b*, and 3*c*. Molded onto both sides of the flat frame 4 to form the chambers 3*a*, 3*b*, and 3*c* are respective walls 6*a*, 6*b*, and 6*c* of a flexible material. These walls 6*a*, 6*b*, and 6*c* define the chambers 3*a*, 3*b*, and 3*c* for receiving the appropriate ingredients.

Proceeding from the chambers 3*a*, 3*b*, and 3*c* are channels 7*a*, 7*b*, and 7*c* that in the region of the transition from the handle 2 into the spoon bowl 1 open into discharge outlets 8*a*, 8*b*, and 8*c*. Each of these discharge outlets is closed off or sealed by a pull tab 9*a*, 9*b*, and 9*c*, so that the ingredients stored in the chambers 3*a*, 3*b*, and 3*c* cannot leak or run out. As needed, these pull tabs 9*a*, 9*b*, and 9*c* can be removed for the selective removal of the appropriate ingredients, and the ingredients can be separately pressed out of their chambers 3*a*, 3*b*, and 3*c* by compressing the appropriate walls 6*a*, 6*b*, and 6*c* like a tube.

The discharge outlets 8*a*, 8*b*, and 8*c* can also at the same time serve as filling openings for mechanically filling the chambers 3*a*, 3*b*, and 3*c* by inserting appropriate filler elements.

In the embodiment of the disposable spoon illustrated in FIGS. 1 to 6, the two chambers 3*a* and 3*b* at the rear end of the handle 2 are disposed parallel to one another, whereas the third chamber 3*c* in the forward region of the handle 2 is disposed between the first two chambers 3*a* and 3*b*, which for this purpose have a reduced cross-sectional area in this region. By way of example, the chamber 3*a* could be used for receiving a tea or coffee concentrate, the chamber 3*b* could be used for receiving condensed milk, and the chamber 3*c* could be used for receiving sugar concentrate.

In the second embodiment illustrated in FIGS. 7 to 12, the rear end of the handle 2 is provided with a chamber 3*a* that extends over the entire width of the handle 2. The cross-sectional area of this chamber 3*a* is reduced in a direction toward the spoon bowl 1, so that there is enough room on both sides for the second and third chambers 3*b* and 3*c*. The rear chamber 3*a* can, for example, be used to receive the tea or coffee concentrate, the chamber 3*b* can be used for receiving sugar concentrate, and the chamber 3*c* can be used for receiving condensed milk.

Finally, in the third embodiment illustrated in FIGS. 13 to 19, the three chambers 3*a*, 3*b*, and 3*c* are disposed one after the other, whereby in the region of the discharge outlets 8*a*, 8*b*, and 8*c* these three chambers extend parallel to one another.

The present invention is, of course, in no way restricted to the specific disclosure of the specification and drawings, but also encompasses any modifications within the scope of the appended claims.

What I claim is:

1. Flatware, especially a spoon, for throwaway or disposable use, with said flatware comprising:

a front work part; and a rear handle that is formed on said work part and in which are provided a plurality of chambers that are separated from one another for receiving different ingredients; respective channels that are separated from one another are provided in said handle and establish communication between said chambers and respective discharge outlets that are disposed in the vicinity of where said work part and said handle merge, and that are closed-off until used.

2. Flatware according to claim 1, in which two chambers are provided in the handle.

3. Flatware according to claim 1, in which three chambers are provided in the handle.

4. Flatware according to claim 1, which includes respective pull tabs for effecting closing-off of said discharge outlets.

5. Flatware according to claim 1, in which said handle comprises a flat, inherently stable frame in which are provided respective openings that are associated with said chambers; and in which, in order to form said chambers about said openings, bulged walls are disposed on opposite sides of said frame, whereby at least a portion of said walls is resiliently deformable.

6. Flatware according to claim 1, in which three chambers are provided, whereby at a rear end of said handle, remote from said work part, a first and a second chamber are disposed next to one another and extend in a longitudinal direction of said handle to a front end of said handle adjacent to said work part, and whereby at said front end of said handle a third chamber is disposed between and parallel to said first and second chambers, with said first and second chambers each having a reduced cross-sectional area in the region of said third chamber.

7. Flatware according to claim 1, in which three chambers are provided, whereby at a rear end of said handle, remote from said work part, a first chamber is disposed that extends over the entire width of said handle, with said first chamber extending, via a portion thereof having a reduced cross-sectional area, through a central portion of said handle to a front end thereof adjacent to said work part, and whereby a second and third chamber are disposed on opposite sides of said first chamber in the region of said portion thereof with said reduced cross-sectional area.

8. Flatware according to claim 1, in which three chambers are provided, whereby starting from a rear end of said handle, remote from said work part, and proceeding toward a front end of said handle, adjacent to said work part, said three chambers are disposed in a staggered arrangement one after the other, with said three chambers extending next to one another at said front end of said handle.

* * * * *